United States Patent [19]

Spaller, Jr.

[11] 4,366,751

[45] Jan. 4, 1983

[54] DEVICE FOR TRANSFERRING LAYERS OF TOW IN A TOW BALER

[75] Inventor: Albert E. Spaller, Jr., Johnson City, Tenn.

[73] Assignee: Eastman Kodak Company, Rochester, N.Y.

[21] Appl. No.: 286,429

[22] Filed: Jul. 24, 1981

[51] Int. Cl.[3] ..... B30B 15/30

[52] U.S. Cl. ..... 100/80; 53/116; 53/475; 100/215; 271/213; 414/77

[58] Field of Search ..... 100/80, 215; 53/116, 53/117, 475, 493; 414/77; 271/213, 191

[56] References Cited

U.S. PATENT DOCUMENTS

| | | | |
|---|---|---|---|
| 2,947,241 | 8/1960 | Guenther et al. | 100/39 |
| 2,947,242 | 8/1960 | Gunether et al. | 100/80 |
| 3,117,513 | 1/1964 | Burnett et al. | 100/215 |
| 3,351,992 | 11/1967 | Carter | 53/116 |
| 4,127,062 | 11/1978 | Egosi | 100/215 |

FOREIGN PATENT DOCUMENTS

| | | | |
|---|---|---|---|
| 2025354 | 1/1980 | United Kingdom | 414/77 |

*Primary Examiner*—Billy J. Wilhite

*Attorney, Agent, or Firm*—Malcolm G. Dunn; Daniel B. Reece, III

[57] ABSTRACT

Device in a tow baler for transferring accumulated layers of filamentary tow, which are temporarily stored in an accumulating chamber and supported on a horizontally slidable hold-up slide, from the accumulating chamber to the tow baling chamber below without undesirably sliding and entangling the tow layers as the hold-up slide is slidably withdrawn from beneath the accumulated layers.

4 Claims, 4 Drawing Figures

DEVICE FOR TRANSFERRING LAYERS OF TOW IN A TOW BALER

TECHNICAL FIELD

The present invention is directed to a device in a tow baler for transferring temporarily stored accumulated layers of tow, such as a tow of filamentary material for cigarette filter rods, from a hold-up bin or accumulating chamber to a press ram follow block within the baler chamber after a previously-formed bale has been pressed out of the tow baler.

Reference is hereby made to U.S. Pat. Nos. 2,947,241; 2,947,242; and 3,351,992 for a description of one of the types of tow balers in which the present invention may be used. In the construction and operation described in these patents, particularly U.S. Pat. No. 3,351,992, there is a hold-up bin or tow bin vertically disposed above a stripper bin, with a hold-up slide moved into position across the bottom opening of the tow bin to form the bottom of the hold-up bin or tow bin while a previously completed bale of tow is being compressed, wrapped and removed from the baling press. Tow is caused to freefall into the hold-up bin or tow bin, with the tow being guided by a tube in such manner that the tow is deposited in parallel straight layers on the surface of a bed comprising previously deposited tow layers. The tube, for example, may make a number of traverse cycles in one direction while simultaneously making one traverse cycle in a direction at right angles to the first-mentioned direction. The hold-up bin is lowered at gradual intervals so that the tow bed level is kept at about a constant distance from the traversing tube. After the previously-formed tow bale has been pressed out, a press ram follow block or platen is moved up within the stripper bin below the tow bin to a position just below the hold-up slide, and then the hold-up slide is slidingly retracted from the tow bin bottom, thus transferring the weight of accumulated tow to the platen. The ram supporting the platen then begins to lower the platen at gradual intervals so as to lower the column of tow within the stripper bin and to maintain a constant tow bed level throughout the manufacture of the tow bale. When a bale cycle is completed, the tow bed has been completely lowered within the stripper bin, and then the hold-up slide is again slidingly moved back into position to form the bottom of the hold-up bin or tow bin so that a new cycle may be started.

When the hold-up slide is retracted from the bottom of the hold-up or tow bin, it slides relative to the layers of tow accumulated on its surface. This sliding action tends to displace a portion of the layers out of their deposited position and cause some undesirable entanglement of the layers. In order to eliminate the undesirable effect of this sliding action, the operators install a plastic sheet, such as a polyethylene sheet, over the hold-up slide and hold it tautly as it and the hold-up slide are moved into position beneath the bottom of the hold-up bin or tow bin. The tow layers are then deposited on top of the polyethylene sheet, as supported by the hold-up slide. When the hold-up slide is retracted, one operator holds the polyethylene sheet in place as another operator manually retracts the hold-up slide so that the hold-up slide slides relative to the polyethylene sheet and to the weight of the accumulated tow layers supported on the sheet. The polyethylene sheet drops along with the accumulated tow layers onto the ram supported platen where the sheet becomes part of the bale. The costs for this plastic sheet and for the time required by the operators to install and to position this sheet become quite significant over a period of operating time. Also, customers for these tow bales have objected to the plastic sheets because when the bale wrap is removed by the customer, the bale tends to slide relative to the slick plastic sheet and may topple, thus promoting an unstable condition.

An object of the invention, therefore, is to be able to slidingly retract the hold-up slide without causing any undesirable entanglement of the accumulated tow layers supported on the hold-up slide.

Another object of the invention is to eliminate the need for installing separate plastic sheets or the like across a hold-up slide for each tow bale to be formed and the attendant costs thereof.

Other objects inherent in the nature of the invention disclosed will thus become apparent to those skilled in the art from the description given herein.

DISCLOSURE OF THE INVENTION

In accordance with the present invention, I provide an improvement in the combination, which involves a vertically disposed tow baler having walls defining a chamber for receiving layers of tow for the formation of a tow bale of filamentary material; a press ram follow block movable in a vertical plane within the chamber for supporting thereon the layers of tow as they are received; and a hold-up slide having a leading edge, a trailing edge and an upper flat surface, and being slidably movable in a horizontal plane to an operable position above the press ram follow block and the chamber, and being slidably movable to an inoperable position outside the chamber; a second set of walls disposed above the first-mentioned walls; the hold-up slide in the aforementioned operable position defining with and above its upper flat surface and with the second set of walls a tow accumulating chamber for temporarily receiving, supporting and accumulating layers of filamentary tow upon the holdup slide upper flat surface while a previously-formed bale is being removed from the tow baler below the hold-up slide during a tow bale pressout cycle; and motive structure for moving the press ram follow block.

The improvement in the above-described combination involves providing an enveloping member or device around the hold-up slide, with the enveloping member being translatable either to the operable or inoperable positions by the hold-up slide as the latter is moved to either of these two positions. The enveloping member defines on its upper surface an intervening supporting surface for the accumulating layers between the upper flat surface of the hold-up slide and the accumulating layers when the enveloping member and the hold-up slide are in operable position. The enveloping member is slidable with respect to the hold-up slide as the latter is moved and is non-slidable with respect to the accumulating tow layers supported on its intervening supporting surface when translated from the operable position to the inoperable position.

The enveloping member comprises a predetermined length of sheet material looped around the hold-up slide and has its terminal ends secured outside the tow accumulating chamber to one of the second set of walls.

The enveloping member is in engagement with the leading and trailing edges of the hold-up slide and is slidable around both edges as the hold-up slide is moved to the operable and inoperable positions.

More specifically, the enveloping member is in engagement with the leading and trailing edges of the hold-up slide, and the accumulating layers, when supported on the intervening supporting surface of the enveloping member, drop from the leading edge onto the press ram follow block as the hold-up slide is moved toward the inoperable position and the enveloping member slides around the leading edge of the hold-up slide as it is translated toward the inoperable position.

BRIEF DESCRIPTION OF DRAWINGS

The details of my invention will be described in connection with the accompanying drawings, in which.

BEST MODE FOR CARRYING OUT THE INVENTION

Figure 1:
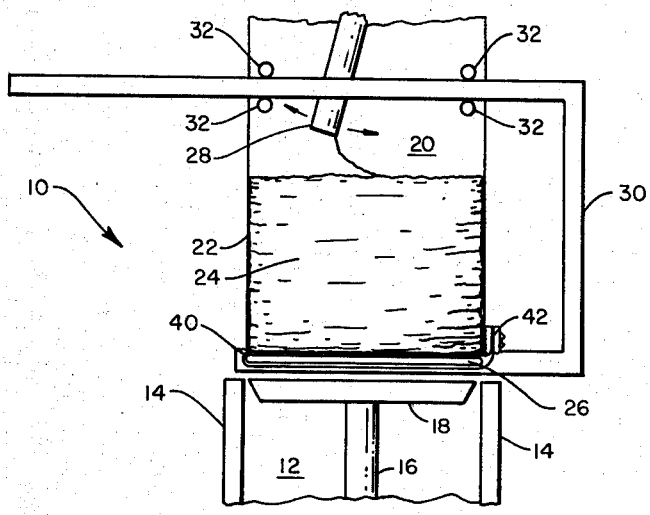
FIG. 1 is a diagramatic elevational view of part of a tow baler illustrating the press ram follow block positioned beneath the hold-up slide and enveloping member which are across the bottom of the accumulating chamber in the operable position with the accumulated layers of tow supported thereon.
Figure 2A:
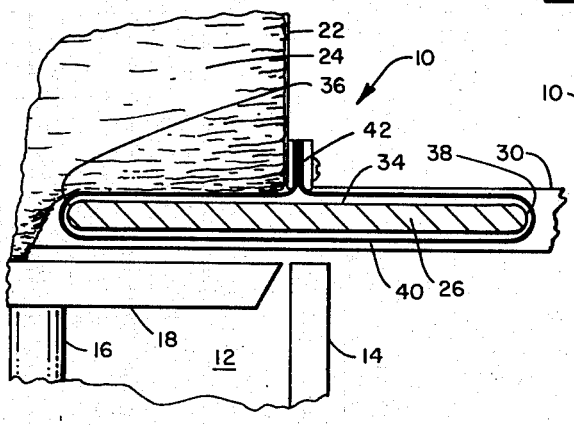
FIG. 2A is an enlarged view of a portion of the one shown in FIG. 2, and illustrates the hold-up slide and the enveloping member with a portion of the enveloping member broken away.
Figure 2:
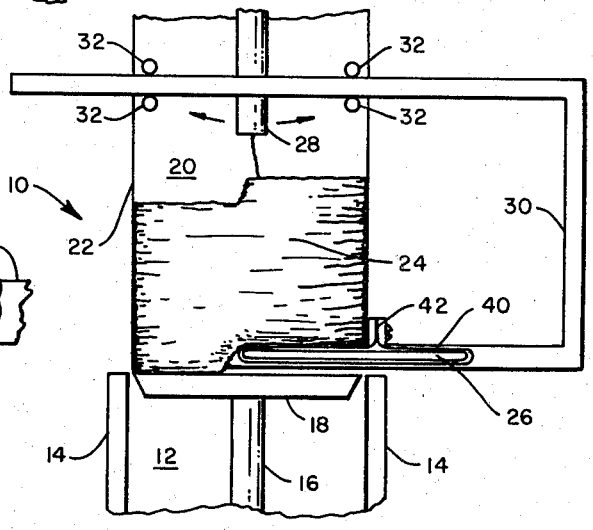
FIG. 2 is a similar view as that shown in FIG. 1 except that the hold-up slide and enveloping member are being moved toward the inoperable position and the accumulated tow layers are dropping onto the press ram follow block.
Figure 3:
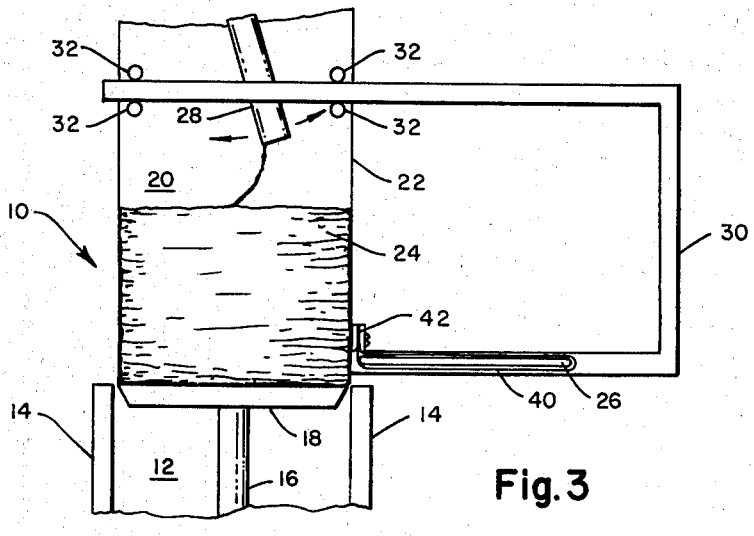
FIG. 3 is a view similar to that shown in FIG. 1 except that the hold-up slide and enveloping member have been completely moved to the inoperable position and the accumulated tow layers have been completely transferred to the press ram follow block.

In reference to FIGS. 1–3, the diagrammatically illustrated tow baler 10 has a chamber 12, as formed by walls 14, for receiving layers of tow for the subsequent formation of a tow bale of filamentary material, such as is used for cigarette filter rods. A hydraulically operated ram 16 supports a press ram follow block 18 for upward and downward vertical movement within the chamber 12.

A tow accumulating chamber 20 is formed by a second set of walls 22, which are vertically positioned above the chamber 12 and its walls 14. The tow accumulating chamber serves to temporarily receive, support and accumulate layers of filamentary tow 24 when a hold-up slide 26 has been slidably moved by the operator from the inoperable position outside the tow accumulating chamber 20 to the operable position across the bottom opening of the tow accumulating chamber 20. The hold-up slide in the operable position is located above the press ram follow block 18 and the chamber 12.

The filamentary tow may be deposited in parallel straight layers in the tow accumulating chamber 20 by the tube 28, which is caused by means not shown to traverse in two different directions, as heretofore mentioned.

The hold-up slide 26 is supported for sliding movement in the horizontal plane by the guide frame 30 and guide rollers 32, and has an upper flat surface 34, a leading edge 36 and a trailing edge 38 (FIG. 2A).

The structure which has been described thus far is well known in the art. My invention involves the use of a sheet-like member 40, formed by a predetermined length of suitable material, which envelopes or loops around the hold-up slide 26 and is secured by its terminal ends 42 to the outside surface of one of the walls 22 of the accumulating chamber 20. This sheet-like enveloping member provides an intervening supporting surface for the accumulating layers of tow between the upper flat surface 34 of the hold-up slide and the accumulated tow layers 24 within the tow accumulating chamber 20 when the sheet-like member and the hold-up slide are in the operable position. As the hold-up slide is slidably moved in the horizontal plane either to the operable or inoperable position, the movement of the hold-up slide causes the sleeve-like member to be translated either to the operable or inoperable position. As the sheet-like member is being translated, its intervening supporting surface is slidable with respect to the hold-up slide but is nonslidable with respect to the accumulated tow layers resting thereon.

Stated another way, the hold-up slide 26 slidably moves within and relative to the sheet-like enveloping member 40, with the enveloping member being in engagement with the leading and trailing edges of the hold-up slide and being slidable around those edges as the hold-up slide is moved to operable and inoperable positions. Thus as the hold-up slide is slidably moved toward either the operable or inoperable position, it causes bodily translation of the sheet-like enveloping member to either the operable or inoperable position. The accumulated tow layers 24 resting on the surface of the sheet-like member successively drop from the leading edge 36 of the hold-up slide to the press ram follow block 18 as the hold-up slide moves toward the inoperable position, as shown in FIG. 2 and FIG. 2A, for instance. In this manner the surface of the sheet-like enveloping member does not slide relative to these accumulated tow layers, but merely drops away from support therewith as the hold-up slide slidably retracts. Prior to this sliding retraction movement of the hold-up slide, the press ram follow block 18 has been moved up beneath the hold-up slide after the tow bale, which the press ram follow block had previously supported, had been pressed out. The accumulated tow layers thus only have about an inch or so to drop from the hold-up slide and its enveloping member to the press ram follow block.

It can now be readily appreciated that the accumulated tow layers in the two accumulating chamber 20 can be transferred to the press ram follow block in chamber 12 without undesirably becoming entangled, and it can thus be readily withdrawn when the customer makes use of the completed tow bale.

The invention has been described in detail with particular reference to preferred embodiments thereof, but it will be understood that variations and modifications can be effected within the spirit and scope of the invention.

I claim:

1. In a vertically disposed tow baler having walls defining a chamber for receiving layers of tow for the formation of a tow bale of filamentary material; a press ram follow block movable in a vertical plane within said chamber for supporting thereon said layers of tow as they are received; and a hold-up slide having a leading edge, a trailing edge, and an upper flat surface, and being slidably movable in a horizontal plane to an operable position above said press ram follow block and said chamber, and being slidably movable to an inoperable position outside said chamber; a second set of walls disposed above the first-mentioned walls; said hold-up slide in said operable position defining with and above its upper flat surface and with said second set of walls a tow accumulating chamber for temporarily receiving, supporting and accumulating layers of filamentary tow upon said hold-up slide upper flat surface while a previously-formed bale is being removed from the tow baler below the hold-up slide during a tow bale pressout cycle; and means for moving said press ram follow block; the improvement comprising:

means enveloping said hold-up slide and being translatable either to said operable or inoperable positions by said hold-up slide as the latter is removed to either of those two positions;

said enveloping means defining on its upper surface an intervening supporting surface for said accumulating layers between the upper flat surface of said hold-up slide and said accumulating layers when said enveloping means and said hold-up slide are in said operable position, and being slidable with respect to said hold-up slide as the latter is moved and non-slidable with respect to the accumulating tow layers supported on its intervening supporting surface when translated from said operable position to said inoperable position.

2. In a vertically disposed tow baler as defined in claim 1 wherein said enveloping means comprises a predetermined length of sheet material looped around said hold-up slide and having its terminal ends secured outside said tow accumulating chamber to one of said second set of walls.

3. In a vertically disposed tow baler as defined in claim 1 wherein said enveloping means is in engagement with said leading and trailing edges of said hold-up slide and is slidable around said edges as said hold-up slide is moved to said operable and inoperable positions.

4. In a vertically disposed tow baler as defined in claim 1, said enveloping means being in engagement with said leading and trailing edges of said hold-up slide and wherein said accumulating layers, when supported on said intervening supporting surface of said enveloping means, drop from said leading edge onto said press ram follow block as said hold-up slide is moved toward the inoperable position and said enveloping means slides around the leading edge of said hold-up slide as it is translated toward said inoperable position.

* * * * *